US006513568B1

(12) United States Patent
Wyser

(10) Patent No.: US 6,513,568 B1
(45) Date of Patent: Feb. 4, 2003

(54) VALVE ASSEMBLY FOR VENTING DIE CASTING MOLDS

(75) Inventor: Johann Wyser, Ligerz (CH)

(73) Assignee: Fondarex SA, Montreux (CH)

( * ) Notice: Subject to any disclaimer, the term of this patent is extended or adjusted under 35 U.S.C. 154(b) by 0 days.

(21) Appl. No.: 09/474,218

(22) Filed: Dec. 29, 1999

(30) Foreign Application Priority Data

Jan. 6, 1999 (CH) ..... 0014/99

(51) Int. Cl.[7] ..... B22D 17/20
(52) U.S. Cl. ..... 164/305; 164/410
(58) Field of Search ..... 164/305, 410

(56) References Cited

U.S. PATENT DOCUMENTS 4,239,080 A * 12/1980 Hodler ..... 164/305
4,852,634 A * 8/1989 Kawai et al. ..... 164/457
5,488,985 A * 2/1996 Wyser ..... 164/305
6,298,903 B1 * 10/2001 Wyser et al. ..... 164/305

* cited by examiner

*Primary Examiner*—M. Alexandra Elve
*Assistant Examiner*—Kevin P. Kerns
(74) *Attorney, Agent, or Firm*—Tarolli, Sundheim, Covell, Tummino & Szabo L.L.P.

(57) ABSTRACT

The valve assembly for venting die casting molds includes a venting channel, a venting valve communicating with the venting channel, as well as an actuating device for closing the venting valve. The actuating device includes a power pick-up member that is axially movable under the influence of the liquid casting material entering the venting channel. The venting valve includes a closure member biased against a stop member and operatively connected to an actuating element. The stop member is pivotable by the power pick-up member such that the closure member of the venting valve is displaced from its open position to its closed position under the influence of the actuating element. Thereby, a reliable closing of the venting valve is ensured, even under unfavorable operating conditions.

19 Claims, 7 Drawing Sheets

VALVE ASSEMBLY FOR VENTING DIE CASTING MOLDS

BACKGROUND OF THE INVENTION

The present invention refers to a valve assembly for venting die casting moulds, comprising a venting channel, a venting valve communicating with the venting channel and having an axially movable valve closure member, and an actuating device for operating the venting valve from an open position to a closed position.

In order to reliably avoid the occurrence of air inclusions in the finished casting during the casting operation, the mould and the cavity in the mould, respectively, have to be vented during the casting operation. Thereby, not only the air contained in the cavity of the mould has to be allowed to escape, but in addition it must be ensured that also the gases escaping from the liquid casting material are removed from the mould cavity.

One of the problems in connection with venting die casting moulds can be seen in the requirement that the venting valve of the valve assembly be closed as late as possible in order to ensure that the mould cavity is vented until it is fully filled with liquid casting material, but that it is also to be avoided that liquid casting material enters the venting valve.

In order to take this problem into account, generally two kinds of valve assemblies for die casting moulds are known, whereby in either case a venting valve is provided that is equipped with a axially back and forth movable valve piston for closing the venting channel. While the valve piston is moved by suitable driving means in a first kind of valve assemblies, the valve piston of a second kind of valve assemblies is operatively connected to a power pick-up member that is operated directly by the liquid casting material flowing from the cavity of the mould into the venting channel.

Suitable driving means for the above mentioned first kind of valve assemblies may include pneumatically or hydraulically operated driving systems for moving the valve piston. The moment in which the closing of the venting valve is initiated can be determined, for example, by means of a sensor that monitors the level of the mould cavity. However, one difficulty observed with such systems consists in the fact that the closing operation takes a considerably long time because the signal initiating the closing operation, mostly an electric signal, has to be transformed into a mechanical movement, for example into the operation of a servo valve. Moreover, for the purpose of closing the venting valve or for the purpose of operating an actuating member that is operatively connected to the valve piston of the venting valve, a predetermined system pressure must be available in order to ensure that the venting valve can be pneumatically or hydraulically closed within the required time period. However, since the operation of a servo valve usually causes a drop in system pressure, it is necessary to rebuild the system pressure again before the servo valve can be closed. It is understood that such valve assemblies are of a quite complicated design and require a high expenditure; moreover, they are subject to be influenced by certain operation parameters.

In contrary, with the second kind of valve assemblies, it is possible to realize very quick acting and reliable venting devices. In order to ensure that a ram pressure can be built up that is high enough to operate the venting valve piston, the venting channel leading from the mould cavity to the power pick-up member is provided with a number of deviations and constrictions. Moreover, the venting channel must have a certain minimal distance and has to be of angled design between the power pick-up member and the real valve body member of the venting valve, in order to ensure that the venting valve is safely closed before the liquid casting material has reached the venting valve. In order to increase the efficiency of such valve assemblies, usually a vacuum pump is connected to the venting valve.

PRIOR ART

U.S. Pat. No. 5,488,985 discloses a valve assembly for venting die casting moulds of the second kind, as described herein above, that comprises a venting channel, a venting valve communicating with the venting channel and an actuating device for closing the venting valve. The actuating device includes a power pick-up member that is operated by the liquid casting material flowing from the mould cavity into the venting channel. The movable closure member of the venting valve is mechanically operatively coupled to the power pick-up member. The power-pick-up member is designed as a push member whose operating stroke is limited to a fraction of the length of the closing stroke of the closure member of the venting valve. Moreover, the closure member of the venting valve is freely movable beyond the operating stroke of the push member. The actuating device comprises a power transmission member for transmitting the impact force from the power pick-up member to the movable closure member of the venting valve.

Even if such a valve assembly operates very reliably in practice, it would be desirable in certain circumstances if the energy required for closing the venting valve would not be raised by the flowing liquid casting material alone. As it is evident from the general formula for calculating the kinetic energy ($E=m\cdot v^2/2$), the energy available for closing the venting valve depends on the mass and the velocity of the liquid casting material. In other words, under certain unfavorable circumstances, the available energy may be not sufficient for closing the venting valve within the required time period, particularly in the case of a low mass of casting material and/or in the case of slowly flowing casting material.

OBJECTS OF THE INVENTION

Thus, it is an object of the invention to provide a valve assembly for venting die casting moulds that always operates reliably and safely, even under the worst operating conditions.

SUMMARY OF THE INVENTION

In order to meet this and other objects, the present invention provides, according to a first aspect, a valve assembly for venting die casting moulds, comprising a venting channel, a venting valve communicating with the venting channel and having an axially movable valve closure member, and an actuating device for operating the venting valve from an open position to a closed position.

An axially movable stop member is adapted to be axially displaced under the influence of the liquid casting material entering the venting channel. The actuating device thereby includes an axially movable actuating element that is operatively connected to the valve closure member and biased towards the stop member such that the valve closure member of the venting valve is movable from its open position to its closed position under the effect of the actuating element.

According to a second aspect, the present invention also provides a valve assembly for venting die casting moulds, comprising a venting channel, a venting valve communicating with the venting channel and having an axially movable valve closure member, and an actuating device for operating the venting valve from an open position to a closed position.

Further, there are provided an axially movable stop member and means for axially displacing the stop member.

The actuating device includes an axially movable actuating element operatively connected to the valve closure member and biased towards the stop member such that the valve closure member of the venting valve is movable from its open position to its closed position under the effect of the actuating element.

Due to the fact that the actuating device of the valve assembly comprises an actuating element that is biased against a stop member and operatively coupled to the closure member of the venting valve, and further due to the fact that the stop member can be operated either by separate driving means or by the casting material itself such that the closure member of the venting valve is movable from its open position to its closed position under the effect of the actuating element driven by the stop member, it is not necessary first to raise a certain force (for example pneumatically) before the closure element of the venting valve can be moved from its open to its closed position once the actuating element is released, i.e. the stop member has moved. This is important insofar as in this way, on the one hand, the closing time of the venting valve can be minimized and, on the other hand, only a short and relatively small impact force acting on the stop member is sufficient for safely and reliably closing the venting valve. As already mentioned, the stop member can be moved under the influence of separate driving means, or under the influence of the casting material. Such separate driving means may include pneumatic, hydraulic or electromagnetic drives. In the case of moving the stop member by the casting material itself, it is understood that the kinetic energy of the flowing liquid casting material is used for moving the stop member. Thereby, both a direct and an indirect operation, e.g. by means of a power pick-up member can be realized.

BRIEF DESCRIPTION OF THE DRAWINGS

In the following, an embodiment of the valve assembly according to the invention will be further described, with reference to the accompanying drawings, in which.

DETAILED DESCRIPTION OF A PREFERRED EMBODIMENT

Figure 1:
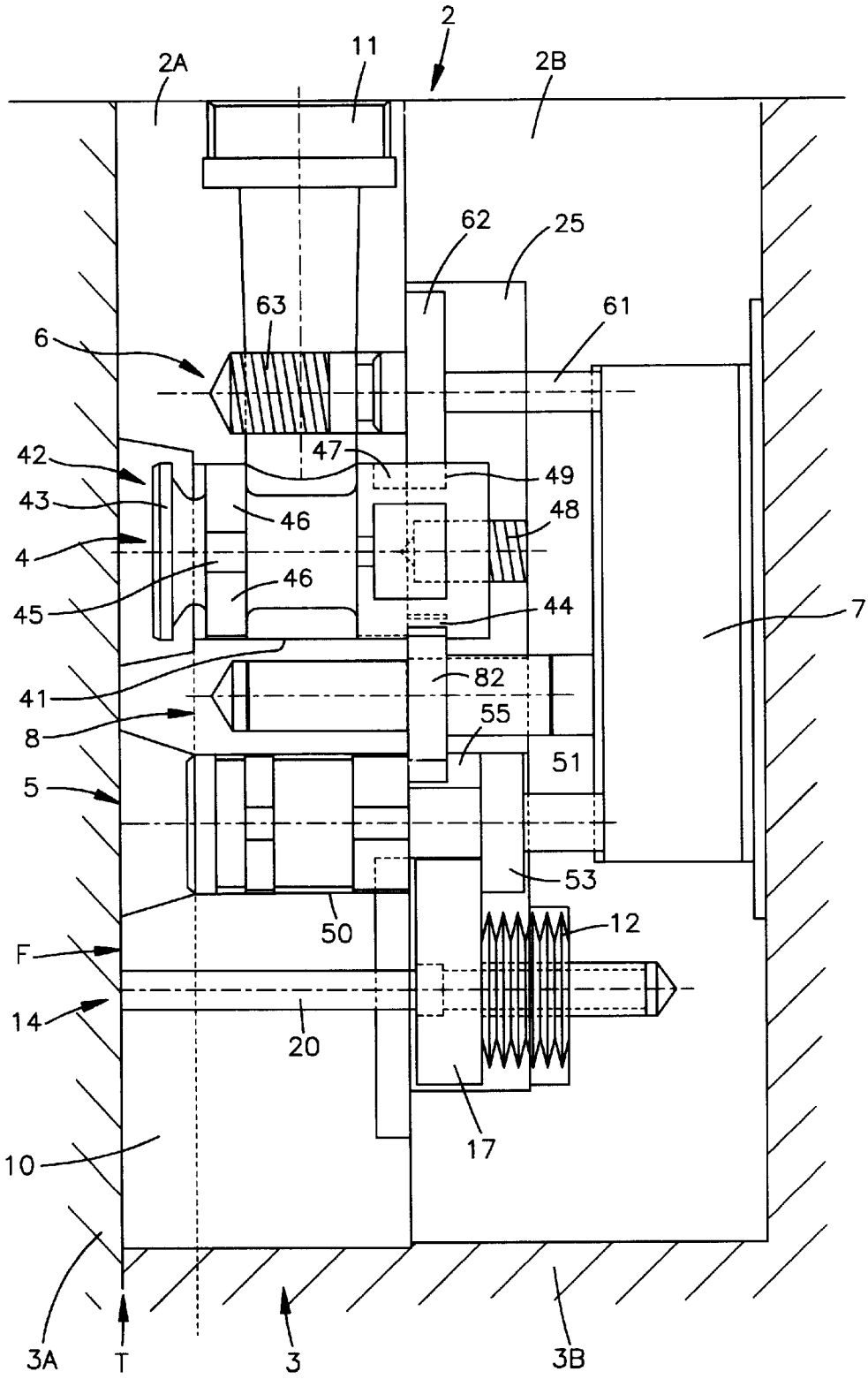
FIG. 1 shows a longitudinal sectional view of a principal illustration of a valve assembly in its initial position.

FIG. 1 shows a longitudinal sectional view of a valve assembly that is operated by the casting material. It is understood that this illustration is to show the basic principle of the valve assembly. Moreover, with the help of FIG. 1, the basic design of the valve assembly is to be explained in more detail, whereby only the characteristics essential for the present invention will be further described. It should be noted that the essential parts and elements of the valve assembly are shown in FIG. 1 as being located in the same vertical plane for a better understanding of the mode of operation of the valve assembly, even if some of those elements, in fact, are located in different vertical planes, as will be readily apparent from the other figures of the drawings.

In FIG. 1, the valve assembly is shown in its initial position. When the valve assembly takes this initial position, the die casting mould whose cavity (not shown) is to be vented by the valve assembly is closed. The two-part mould 3, comprising a first mould portion 3A and a second mould portion 3B, is shown in FIG. 1 by way of suggestion. The separation face T of the mould 3, i.e. the face where the two mould portions 3A, 3B adjoin, is flush with the front face F of the valve assembly.

The valve assembly comprises a two-part housing 2, whereby the one portion of the housing, shown as the left side housing in FIG. 1, is designated by reference numeral 2A, while the other portion of the housing, shown as the right side housing in FIG. 1, is designated by reference numeral 2B. The left housing portion 2A is provided with a venting channel 10 that opens into the front face F and communicates with the cavity provided in the interior of the mould 3. Received in that first left housing portion 2A are a venting valve 4, a power pick-up member 5, an actuating member 6, a drive member 8 as well as two ejecting members 14, 15 that are supported by two spring assemblies only one of which is shown at reference number 12. However, in FIG. 1, only one of the ejecting members, i.e. the ejecting member 14 are visible. The two ejecting members 14, 15 each comprise a push rod member, only one of which is shown at reference number 20 and which towers above the front face F once the mould 3 is opened. The venting valve 4, the power pick-up member 5, the actuating member 6, the drive member 8 and the two ejecting members 14, 15 are arranged with their axes running parallel to each other.

In order to enable the second, right housing portion 2B to receive the afore mentioned elements, it is provided with a recess 25 having essentially double-T shape (cf. FIG. 4), whereby some of the side walls of this recess 25 serve as a anti-rotation lock for some of the aforementioned elements, as will be described in more details herein after.

The real valve member 4 is designed as a plunge piston valve, the longitudinal axis thereof running perpendicular to the front face F of the housing 2. The valve member 4 comprises a valve cylinder 41 communicating with the venting channel 10 and a closure element in form of a valve piston 42 slidably received in the valve cylinder 41. The valve piston 42 has a valve piston head 43 protruding into the venting channel 10 at the front face F of the valve assembly once the valve member 4 is in its open position and plunges into the valve cylinder 41 in order to close the valve member 4. Behind the valve piston head 43, a collar 45 is provided which comprises a number of radially running slots 46. Through these slots 46, the air escaping from the venting channel 10 can flow into an outlet channel 11 located at the top of the housing 2. A suction pipe (not shown) of a vacuum pump (not shown) can be connected to the outlet channel 11. In order to keep the valve member 4 in its initial position shown in FIG. 1, i.e. in its open position, the valve piston 42 is under the influence of a pressure spring member 48 that rests against the bottom of the recess 25 provided in the other housing portion 2B.

In order to close the valve member 4, there is provided an actuating device consisting of a plurality of elements. The essential components of that actuating device are constituted by the power pick-up member 5, the actuating element 6 as well as a stop member 7 provided in the second housing portion 2B and comprising a swiveling locking member 70 (see FIG. 5) by means of which the actuating member 6 can be locked in its initial position. The power pick-up member 5 is mechanically operatively connected to the valve piston 42 by means of the driver member B. For this purpose, the driver member 8 located between the power pick-up member 5 and the valve member 4 comprises a collar 82 that engages both a recess 55 provided in the power pick-up member 5 and a recess 44 provided in the valve piston 42. The axial length of the recess 55 in the power pick-up member 5 is greater than the thickness of the collar 82 engaging the recess 55 by an amount that corresponds to the length of the closing stroke of the valve piston 42.

The actuating element 6 is biased by means of a spring member 63 and comprises a cylindrical shaft member 61 located on its back side. The cylindrical shaft member 61 rests against the locking member 70 under the influence of the spring member 63.

The power pick-up member 5 is designed as a short stroke pushing piston member that is slidably received in a working cylinder 50 communicating with the venting channel 10. The back side of the power pick-up member 5 forms an extension member 51 that extends backwards to the locking member 70. In order to limit the operational stroke of the power pick-up member 5, it is provided with a collar 53 adapted to rest against the bottom of the recess 25.

Each of the two ejecting members 14, 15 is provided with a driver disc member 17 and 18, respectively, that also engage the recess 55 provided in the power pick-up member 5. Thereby, the length of the recess 55 in the power pick-up member 5 is longer than the thickness of the driver disc member 17, 18 by an amount that corresponds to the operational stroke of the power pick-up member 5 (ca. 1 mm). The spring assembly 12 is located between the bottom of the recess 25 provided in the second housing portion 2B and the driver disc members 17 and 18, respectively.

In order to bias the spring assemblies 12, 13, the two push rod members 20, 21 are provided that extend through the first housing portion 2A in a freely slidable manner. In the initial position, the push rod member 20 towers above the front face F out of the first housing portion 2A. When the two mould portions 3A and 3B of the mould 3 adjoin, the push rod member 20 is pushed back and biases the spring assembly 12 as shown in FIG. 1. The same process occurs with the other spring assembly and the other push rod member but which is not shown.

Figure 2:
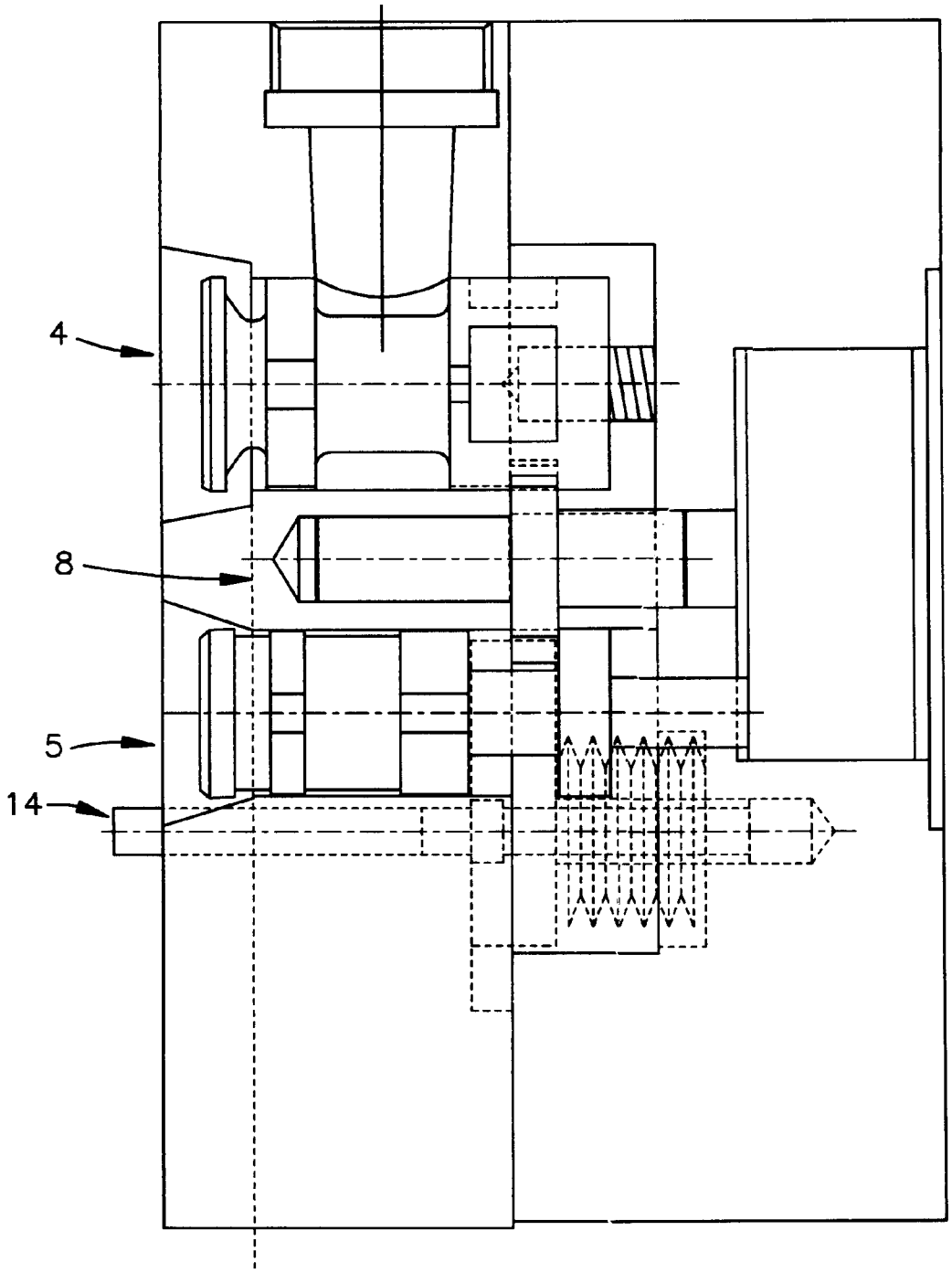
FIG. 2 shows a longitudinal sectional view of an embodiment of a real valve assembly in its initial position.

FIG. 2 shows a longitudinal sectional view of an embodiment of a real valve assembly in its initial position. This illustration clearly shows that the actuating member 6 and the ejecting members 14, 15 are not located in the same vertical plane as the power pick-up member 5, the driver member 8 and the venting valve 4.

Figure 3:
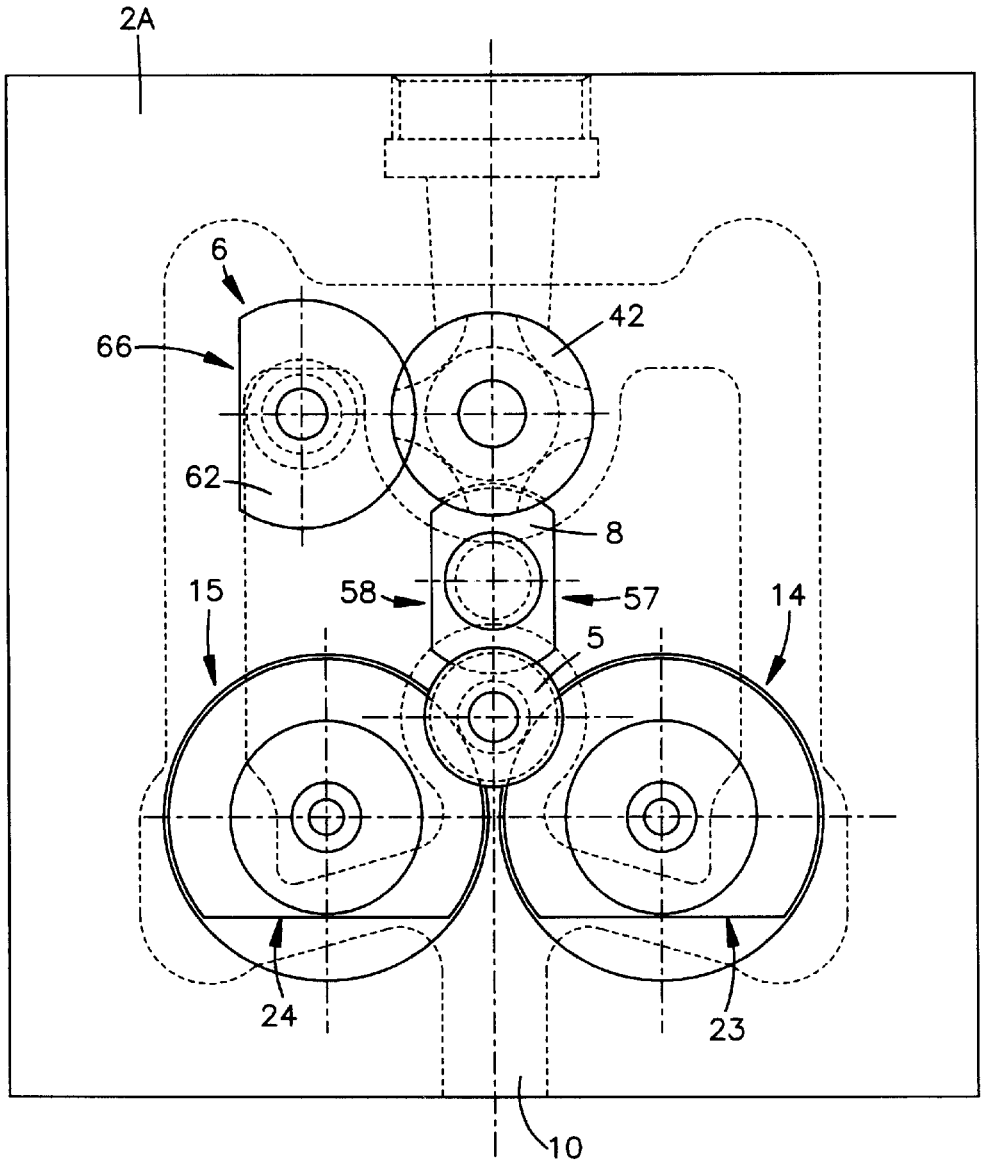
FIG. 3 shows a view of the interior of the first housing portion of the valve assembly.

FIG. 3 shows a view of the interior of the first housing portion 2A of the valve assembly, whereby the valve piston 42, the power pick-up member 5, the actuating element 6 and the two ejecting members 14, 15 are shown in a back view. Moreover, the shape of the venting channel 10 is shown by suggestion by a broken line. Furthermore, it can be seen that the collar 62 of the actuating member 6 as well as the two driver disc members 17, 18 are provided each with a flattened portion 23, 24 and 66, respectively, and that the collar 82 of the driver member 8 is provided with two flattened portions 57 and 58.

Figure 4:
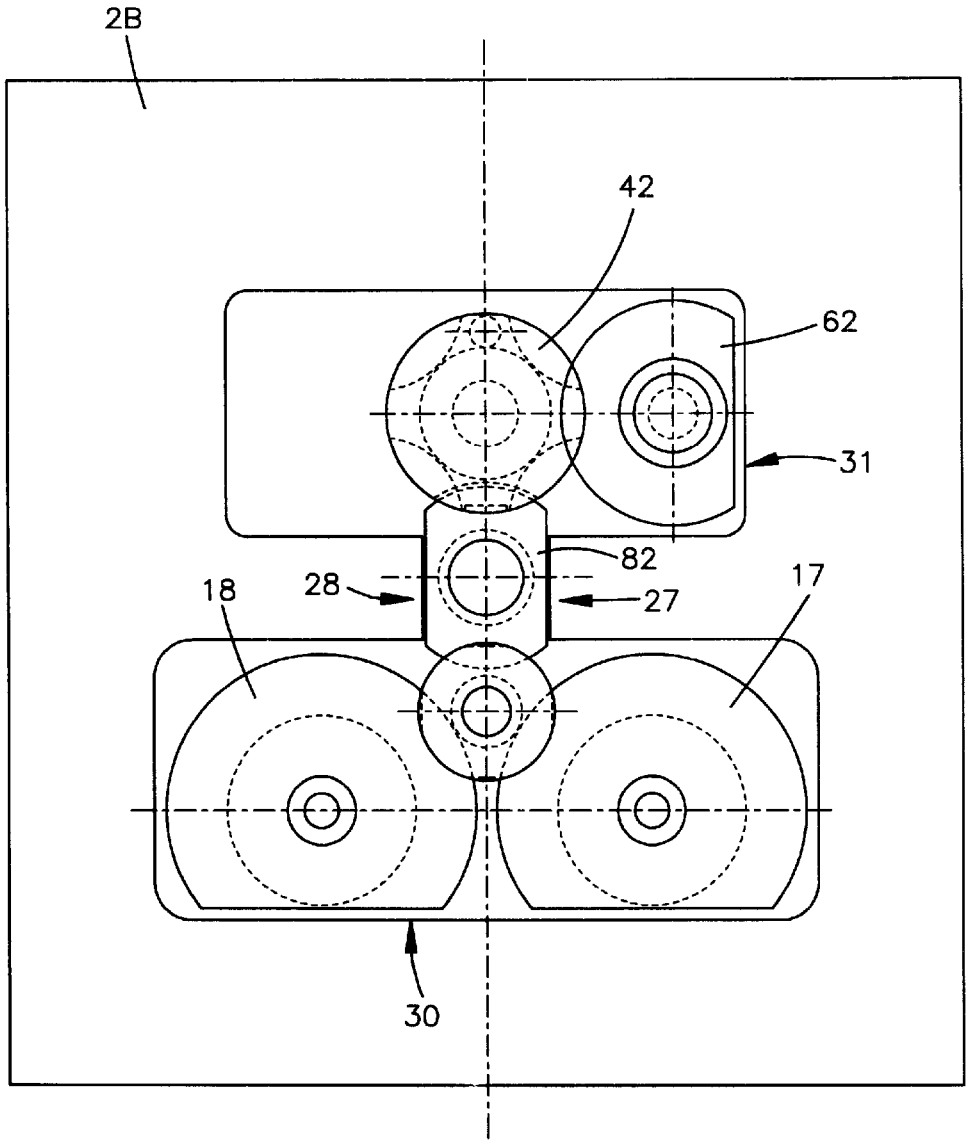
FIG. 4 shows a top view of the second housing portion of the valve assembly.

FIG. 4 shows a top view of the second housing portion 2B of the valve assembly, whereby the valve piston 42, the power pick-up member 5, the actuating element 6, the driver member 8 as well as the two ejecting members 14, 1S are shown in a front view. This illustration clearly shows the recess 25 provided in the second housing portion 2B and having essentially double-T shape. Particular side walls of the recess 25 serve as guiding faces inasmuch as the flattened portions of the collar 62 of the actuating element 6, of the driver disc members 17, 18 as well as of the collar 82 of the driver member 8 are guided by the lateral faces 27, 28 30 and 31, respectively, of the recess 25. By the provision of flattened portions of the collar 62 of the actuating element 6, of the driver disc members 17, 18 as well as of the collar 82 of the driver member 8, the insertion and the assembly of the mentioned elements is facilitated, while the provision of the mentioned lateral faces 27, 28, 30 and 31 ensures that the mentioned elements are locked against rotation once the two housing portions 2A, 2B are joined together.

In the following, the cooperation of the actuating element 6, the power pick-up member 5 and the stop member 7 shall be explained in more detail, with reference to FIG. 5 which shows a schematic sectional view of the valve assembly. For simplicity's sake, the actuating element 6, the power pick-up member 5 and the stop member 7 are shown as if they were located in a common plane.

The locking member 70 of the stop member 7 can be rotated around an axis 71 and is kept in an initial locking position in which it locks the actuating member 6 by means of a return spring member 72. As soon as the power pick-up member 5 is laterally moved backwards towards the locking member 70, its extension 51 rests against the locking member 70 with the result that the locking-member member 70 is rotated around the axis 71 in the direction of arrow P; thus the actuating element 6 is released. Then, the actuating element 6 is moved backwards under the influence of the spring member 63. Thereby, the disc shaped collar 62 of the actuating element 6 engages the wall of the recessed portion 47 of the valve piston 42 (FIG. 1) with the result that the valve piston 42 is moved from its open position into its closed position.

The locking member 70 comprises a recessed portion 68 located in the region of the shaft member 61 of the actuating member 6, such that the shaft member 61 rests against the locking member only with a fraction of its mean cross sectional area. Thus, a pivoting movement of the locking member 70 by an amount of 2° in direction of the arrow P is sufficient to release the actuating element 6.

The longitudinal axis of the actuating member 6 is offset with regard to the axis of rotation 71 of the locking member 70 by a distance L2 and the longitudinal axis of the power pick-up member 5 is offset with regard to the axis of rotation 71 of the locking member 70 by a distance Ll. While the longitudinal axis 64 of the actuating element 6 is offset towards the one side of the axis of rotation 71 of the locking member 70 by several millimeters, the point of engagement of the actuating element 6 essentially coincides with the axis of rotation 71 of the locking member 70. Thus, the spring member 63 of the actuating member 6 acts on the locking member 70 in the neutral axis. The result is that, on the one hand, the spring member 63 does not decrease the effect of the return spring 72 and, on the other hand, already a relatively small amount of pressure acting on the power pick-up member 5 is sufficient to swivel the locking member 70 around its axis of rotation 71 in the direction of arrow P and, thereby, to release the actuating member 5.

Figure 6:
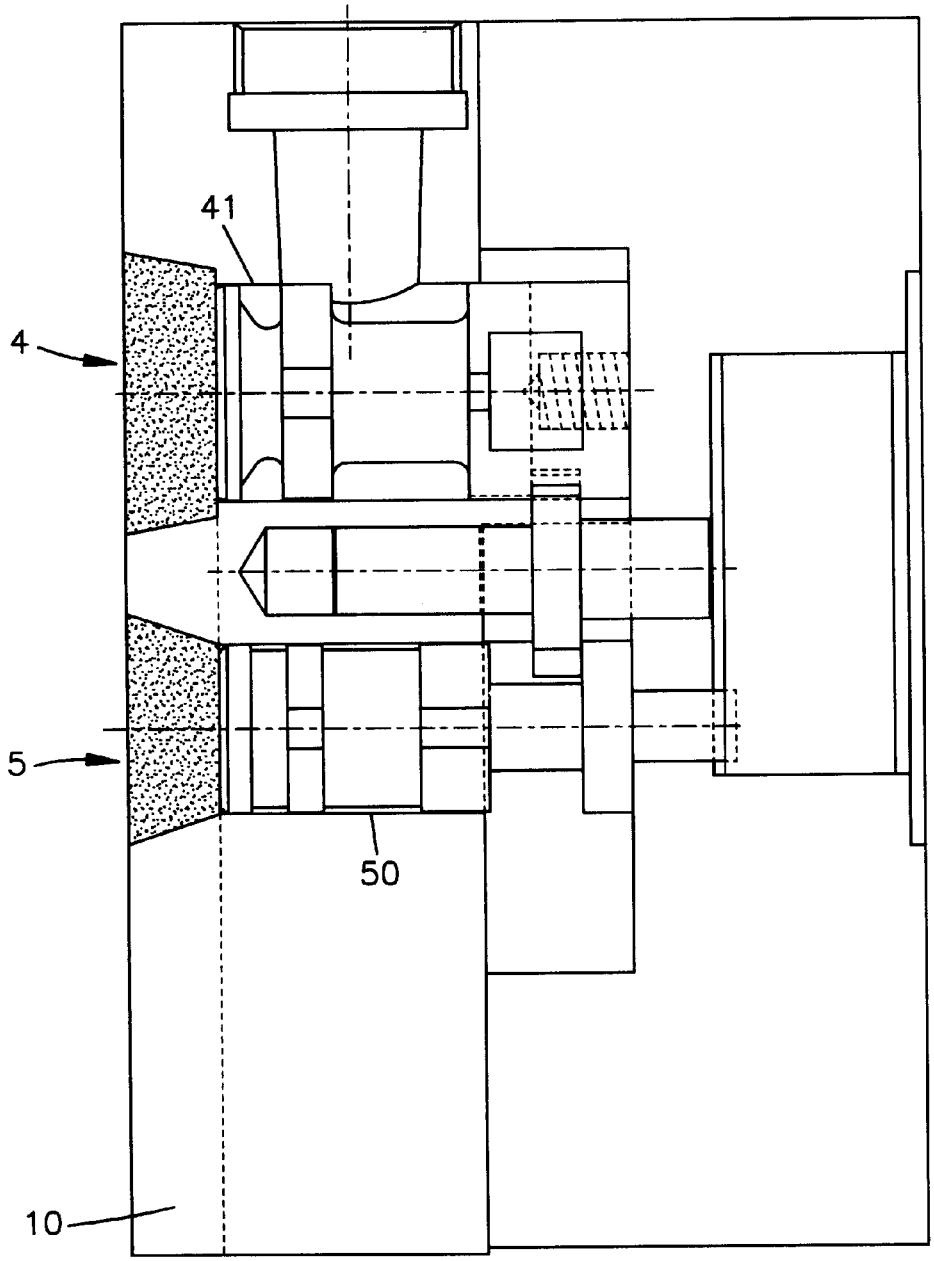
FIG. 6 shows a longitudinal sectional view of the valve assembly of FIG. 2 in its closed position.

FIG. 6 shows the valve assembly in its closed position. In this illustration, it can be seen that the liquid casting material can penetrate the cylinder chamber 50 of the power pick-up member 5 and, later, the cylinder chamber 41 of the valve member 4 only by a small amount. Thus, the later to be performed removal of the rigid casting material from the venting channel 10 does not present any difficulties.

Figure 7:
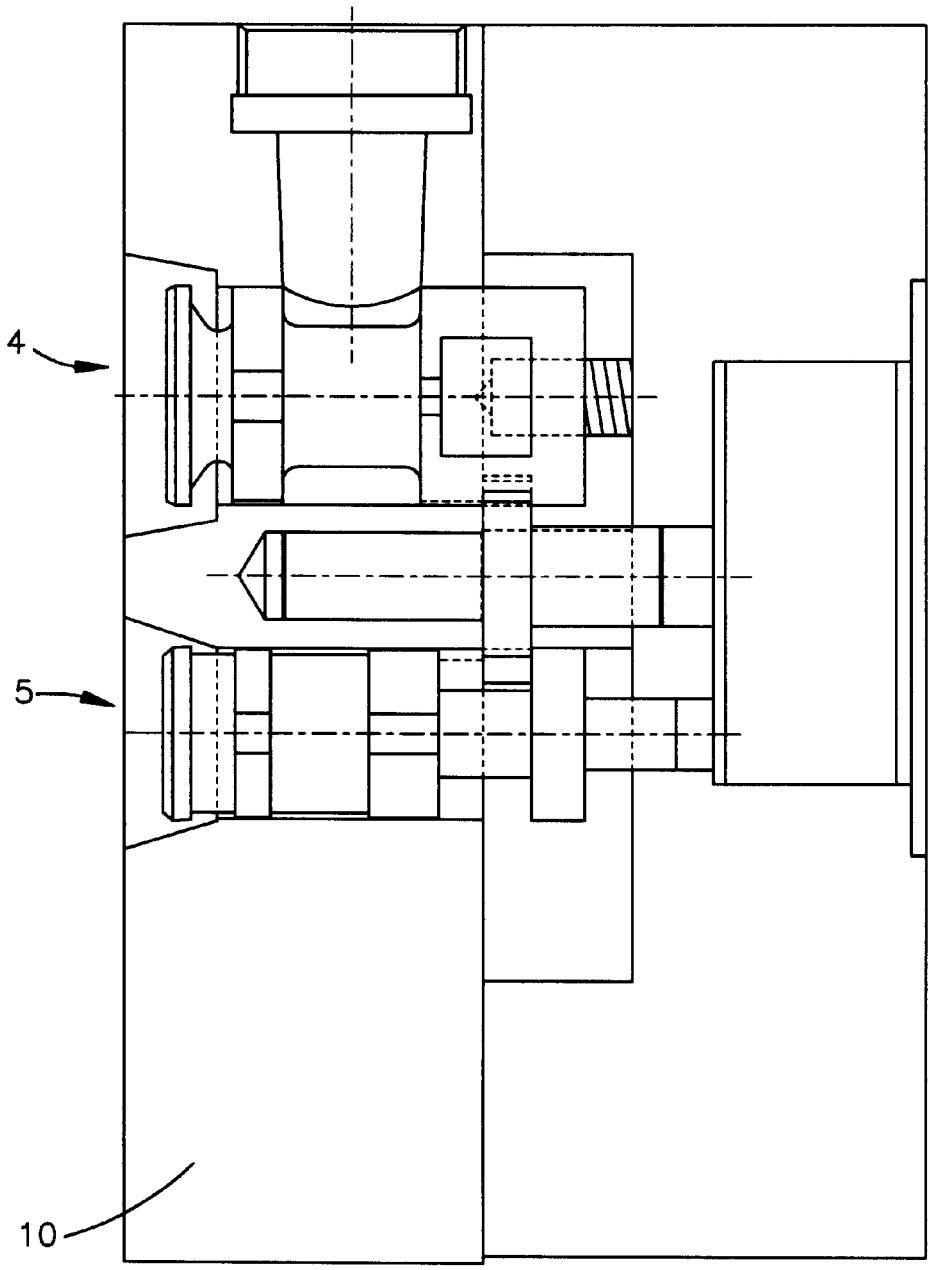
FIG. 7 shows a longitudinal sectional view of the valve assembly of FIG. 2 in its initial position.

FIG. 7 shows an illustration of the valve assembly once the die casting mould has been opened. The return movement of the power pick-up member 5, of the actuating element 6 as well as of the driver member 8 into the initial position, as shown in that drawing, is performed, as already mentioned, by means of the spring assembly 12 (cf. FIG. 1). Moreover, it can be seen in FIG. 7 that the power, pick-up member 5 has been moved forward into the venting channel 10 to such an extent that its head and his front face, respectively, towers above the bottom of the venting channel 10. In this position, it is possible to blow air past the power pick-up member 5 through a channel (not shown) running through the first housing portion 2A to the power pick-up member 5. Furthermore, air can be blown out through the venting valve 4. By this blowing out of air, not only a cleaning effect results, but these element, i.e. the power pick-up member 5 and the venting valve 4, are also cooled. It is understood that other media can be used instead of air, as long as they have the desired cleaning and/or cooling effect or which support the removal of the excess material from the valve assembly.

In the following, the mode of operation of the valve assembly will be further explained, with reference to FIGS. 1 and 5. As soon as the liquid casting material (not shown) proceeding into the venting channel 10 has reached the power pick-up member 5, the latter one is suddenly moved backwards towards the locking member 70. Thereby, the extension 51 of the power pick-up member 5 comes to a rest on the locking member 70 which now will be pivoted around its axis 71 in the direction of arrow P to release the actuating member 6. Thereafter, the actuating member 6 is moved backwards under the influence of the force exerted by the spring member 63. Thereby, the disc-shaped collar 62 of the actuating element engages the wall portion 49 of the recessed portion 47 provided on the valve piston 42, with the result that the valve piston is moved from its open position into its closed position. During that closing movement, also the driver member 8 is moved backwards. Due to the fact that the axial width of the recessed portion 55 is greater than the thickness of the collar 82 of the driver member 8 engaging that recessed portion 55, namely greater by an amount essentially corresponding to the length of the closing stroke of the valve piston 42, the valve piston 42, together with the drive member 8, can be moved backwards by an amount exceeding the operating stroke of the power pick-up member 5.

Even if the kinetic energy of the casting material is used for moving the locking member 70, the energy required for closing the venting valve 4 has not to be supplied exclusively by the casting material, but the valve 4 is also closed under the influence of the force of the spring member 63 as soon as the actuating member 6 is released. Thus, also under unfavorable operating conditions due to low amounts of casting material and/or low flowing velocity of the casting material, it is ensured that the venting valve 4 is safely closed within the required time limit.

Instead of providing a spring member 63 for biasing the actuating member 6, it would be also possible to hydraulically bias the actuating member and to move it by providing suitable hydraulic or pneumatic means. It might also be possible to provide electromagnetic means for that purpose. It is understood that a corresponding channel would have to be provided (not shown) for feeding the required gaseous or fluid media.

If the energy transmitted by the fluid casting material to the power pick-up member 5 exceeds a certain amount, the valve piston 42 can be moved from its open position to its closed position without the support of the actuating element 6. In this case, the impulse transmitted by the power pick-up member 5 via the driver member 8 to the valve piston 42 to move the valve piston 42 together with the driver member 8 into its closed position whereby this movement takes place under idling condition along a path that exceeds the operating stroke of the power pick-up member 5. In order to limit the amount of energy transmitted from the flowing casting material to the power pick-up member 5, particularly in the case of large amount of casting material and/or of casting material flowing with a high velocity, the operating stroke of the power pick-up member 5 is limited to approximately 1 millimeter by the provision of the collar 53 hitting against the bottom of the recess 25.

Figure 5:
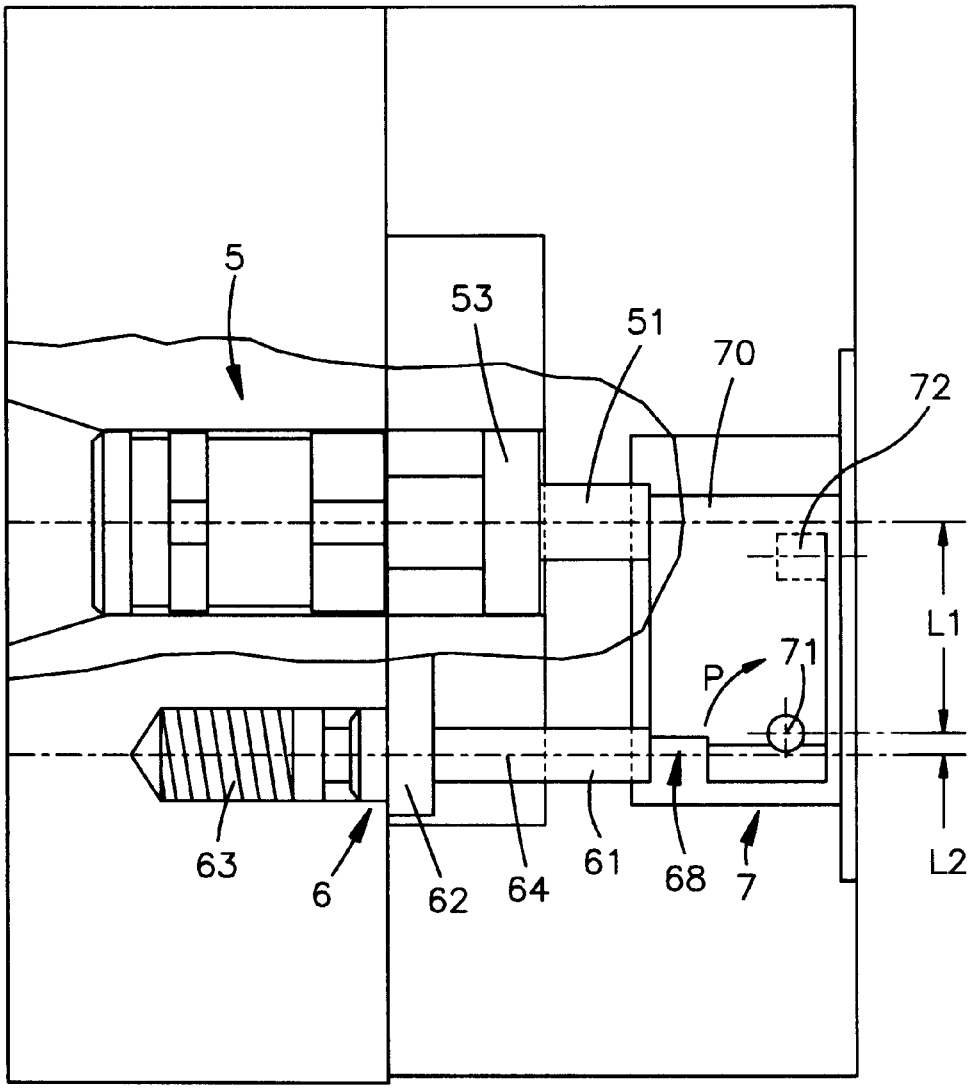
FIG. 5 shows a schematic cross sectional view of the valve assembly of FIG. 2.

The casting operation having been completed, the two ejecting members 14, 15 serve not only for ejecting the casting material that is present in the venting channel 10, but also for the return of the power pick-up member 5, of the driver member 8, of the actuating element 6 and of the valve piston 42 to the initial position as shown in FIG. 5. For ejecting the solidified casting material and for the return of the above mentioned elements, the spring assembly 12 consists of a plurality of disc springs. Once the die casting mould has been opened, the spring assembly 12 is released since the push rod 20 is freed from the front face when the corresponding portion 3B of the mould has been removed. The driver disc members 17, 18 move the power pick-up member 5, the driver member 8, the actuating element 6 and the valve piston 42 to the initial position under the influence of the biased spring assembly 12. The other spring assembly which is not shown is also released in the same manner as the spring assembly 12 by the other push rod which is not shown.

Even if the stop member 7 is moved by virtue of energy transmission from the liquid casting material, as explained with reference to the present embodiment of a valve assembly, other embodiment could be realized in which the stop member 7 is moved by a suitable separate means. For example, the stop member could be moved by pneumatic, hydraulic or electromagnetic means, whereby the moment of release could be controlled by a timer or by a sensor.

The essential advantages of a valve assembly as discussed herein before can be summed up as follows:

- reliable closing of the venting valve even under unfavorable operating conditions;
- simple design;
- uncomplicated, quick assembly of the valve assembly;
- limiting of the amount of energy transmitted from the casting material to the actuating device;
- essentially no parts that are subject to wear, if required, all parts and elements can easily be replaced;
- a wide variety of cooling agents, cleaning agents and/or separating means in solid (powder), liquid or gaseous form can be blown past the power pick-up member or the valve piston.

What is claimed is:

1. A valve assembly for venting die casting molds, comprising:

a venting channel means;

a venting valve means communicating with said venting channel means and having an axially movable valve closure member;

an axially movable actuating element having a spring element and being connected to said valve closure member that axially moves said valve closure member from an open position to a closed position upon pressure applied by a liquid casting material entering said venting channel means;

a pivotally movable locking member engaging said actuating element and responding to the liquid casting material entering said venting channel means;

said spring element biasing said actuating element into engagement with said locking member, the pivotal movement of said locking member releasing said actuating element from engagement with said locking member;

said spring element unbiasing and moving said actuating element in response to the pivotal movement of said locking member to axially move said valve closure member to the closed position.

2. A valve assembly according to claim 1 in which said actuating element further comprises a power pick-up means that is axially displaced towards said locking member under the influence of the liquid casting material entering said venting channel means.

3. A valve assembly according to claim 2, wherein a driver member couples said valve closure member of said venting valve means to said power pick-up means.

4. A valve assembly according to claim 3 in which said driver member is located between said valve closure member of said venting valve means and said power pick-up means, said driver member comprising a disc-shaped collar means engaging both a recessed portion provided in said valve closure member and a recessed portion provided in said power pick-up means.

5. A valve assembly according to claim 4 in which a width of said recessed portion provided in said power pick-up means is greater than a thickness of said disc-shaped collar means engaging said recessed portion by an amount that corresponds to a length of the operating stroke of said closure member, such that said closure member, together with said driver member, moves from the open position to the closed position along an additional path corresponding in length to the operating stroke of said power pick-up means.

6. A valve assembly according to claim 4 in which said collar means of said driver member means has a generally circular configuration with two flattened portions running parallel to each other, whereby one portion of a two-part housing means is provided with guiding face means which guides said collar means of said driver member.

7. A valve assembly according to claim 3 in which said actuating element comprises a disc-shaped collar means engaging a recessed portion provided in said closure member, whereby the width of said recessed portion provided in said closure member is greater than the thickness of said disc-shaped collar means of said actuating element engaging said recessed portion by an amount that corresponds to the length of the operating stroke of said closure member, said closure member, together with said driver member is moved relative to said actuating element in the closing direction.

8. A valve assembly according to claim 7 in which said collar of said actuating element has a generally circular configuration with a flattened portion, whereby one portion of a two-part housing means is provided with guiding face means which prevents said collar means of said driver member means from rotating.

9. A valve assembly according to claim 2 wherein a cylinder chamber means receives said power pick-up means, whereby said power pick-up means is movable forward into said venting channel means to such an extent that a front face of said power pick-up means towers above a bottom of said venting channel means.

10. A valve assembly according to claim 9 in which said power pick-up means is provided with a collar means located adjacent to said front face, a diameter of said collar means essentially corresponding to the diameter of said cylinder chamber means, and in which said power pick-up means is provided with a collar means having axially extending passages.

11. A valve assembly according to claim 3 in which said valve assembly comprises a two-part housing means, whereby said power pick-up means, said closure member, said actuating element and said driver member are received in said housing means in parallel relationship.

12. A valve assembly for venting die casting moulds, comprising:

a venting channel means;

a venting valve means communicating with said venting channel means and having an axially movable valve closure member;

an axially movable actuating element having a spring element engaging said valve closure member and that axially moves said valve closure member from an open position to a closed position;

a pivotally movable locking member engaging said actuating element;

a driver member that pivotally moves said locking member upon pressure applied by a liquid casting material;

said spring element biasing said actuating element into engagement with said locking member, the pivotal movement said spring element unbiasing and moving said actuating element in response to pivotal movement of said locking member to axially move said valve closure member to the closed position.

13. A valve assembly according to claim 12, further comprising electromagnetic, pneumatic or hydraulic means that pivotally moves said locking member.

14. A valve assembly according to claim 12 in which said locking member includes a spring means which keeps said locking member in an initial locking position.

15. A valve assembly according to 14 claim in which said actuating element means comprises an extension shaft means resting with a fraction of a front face of said shaft means against said locking member.

16. A valve assembly according to claim 14 in which said actuating element is arranged in parallel relationship with said power pick-up means, whereby a longitudinal axis of said actuating element is offset by a first distance with regard to an axis of rotation of said locking member in a first direction away from one side of the axis of rotation by a first distance, and whereby the longitudinal axis of said power pick-up means is offset with regard to the axis of rotation of said locking member in a second direction opposite the first direction and away from the opposite side of the axis of rotation by a second distance.

17. A valve assembly according to claim 16 in which the distance between the axis of rotation of said locking member and the longitudinal axis of said actuating element corresponds to a fraction of the distance between the axis of rotation of said locking member and the longitudinal axis of said power pick-up means.

18. A valve assembly according to claim 14 in which said locking member is pivotally received in a housing portion of a two-part housing means.

19. A valve assembly according to claim 17 in which said actuating element is biased against said locking member by pneumatic means, by hydraulic means or by spring means.

* * * * *

UNITED STATES PATENT AND TRADEMARK OFFICE

CERTIFICATE OF CORRECTION

PATENT NO. : 6,513,568 B1
DATED : February 4, 2003
INVENTOR(S) : Johann Wyser

It is certified that error appears in the above-identified patent and that said Letters Patent is hereby corrected as shown below:

Column 10,
Line 21, delete “3” and insert -- 2 --.
Line 44, after “movement” insert -- of said locking member releasing said actuating element from engagement with said locking member; --.

Column 12,
Line 4, delete “17” and insert -- 12 --.

Signed and Sealed this

Eleventh Day of November, 2003

JAMES E. ROGAN
*Director of the United States Patent and Trademark Office*